US007861649B2

(12) United States Patent
Bobren et al.

(10) Patent No.: US 7,861,649 B2
(45) Date of Patent: Jan. 4, 2011

(54) SELF-ADJUSTING STRIPPER PIN FOR STRAPPING MACHINE STRAP CHUTE

(75) Inventors: Allan J. Bobren, Streamwood, IL (US); James A. Haberstroh, Vernon Hills, IL (US); Kevin A. Bruzzesi, Cary, IL (US); Dustin D. Elliott, Prospect Heights, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 12/624,713

(22) Filed: Nov. 24, 2009

(65) Prior Publication Data

US 2010/0154661 A1 Jun. 24, 2010

Related U.S. Application Data

(60) Provisional application No. 61/139,185, filed on Dec. 19, 2008.

(51) Int. Cl.
*B65B 13/04* (2006.01)

(52) U.S. Cl. ..... 100/26; 53/589

(58) Field of Classification Search ..... 100/25, 100/26; 53/589

See application file for complete search history.

(56) References Cited

U.S. PATENT DOCUMENTS 2,880,905 A 4/1959 Meissner
3,387,556 A 6/1968 Cranston, Jr. et al.
4,781,110 A * 11/1988 Sakaki et al. ..... 100/26
5,249,518 A * 10/1993 Abrams ..... 100/26
6,073,425 A * 6/2000 Chin-Chang et al. ..... 53/589
6,910,318 B2 6/2005 Bobren et al.
6,951,170 B2 * 10/2005 Lininger et al. ..... 100/26
6,962,109 B2 11/2005 Bobren et al.
7,263,928 B1 9/2007 Holden et al.
7,395,754 B1 7/2008 Bobren et al.

FOREIGN PATENT DOCUMENTS

EP 1059234 A1 12/2000

OTHER PUBLICATIONS

International Search Report and Written Opinion of the International Searching Authority issued in connection with PCT/US2009/066956 on Mar. 19, 2010.

* cited by examiner

*Primary Examiner*—Jimmy T Nguyen
(74) *Attorney, Agent, or Firm*—Levenfeld Pearlstein, LLC

(57) ABSTRACT

A self-adjusting stripper pin is for use in a strap chute for a strapping machine and includes a mount mounted to a fixed portion of the strapping machine, a reciprocating pin disposed in the mount for reciprocating movement relative to the mount and a pin spring disposed between the pin and the mount for biasedly mounting the pin to the mount. When the movable wall of the strapping machine is moved toward the fixed wall of the strapping machine, the pin moves out from the track to allow the strap to traverse therethrough and when the movable wall is moved away from the fixed wall, the pin is moved into the track to urge the strap out of the track. The spring positions the pin at about an outer edge of the track when the movable wall is moved away from the fixed wall.

18 Claims, 4 Drawing Sheets

Fig. 1
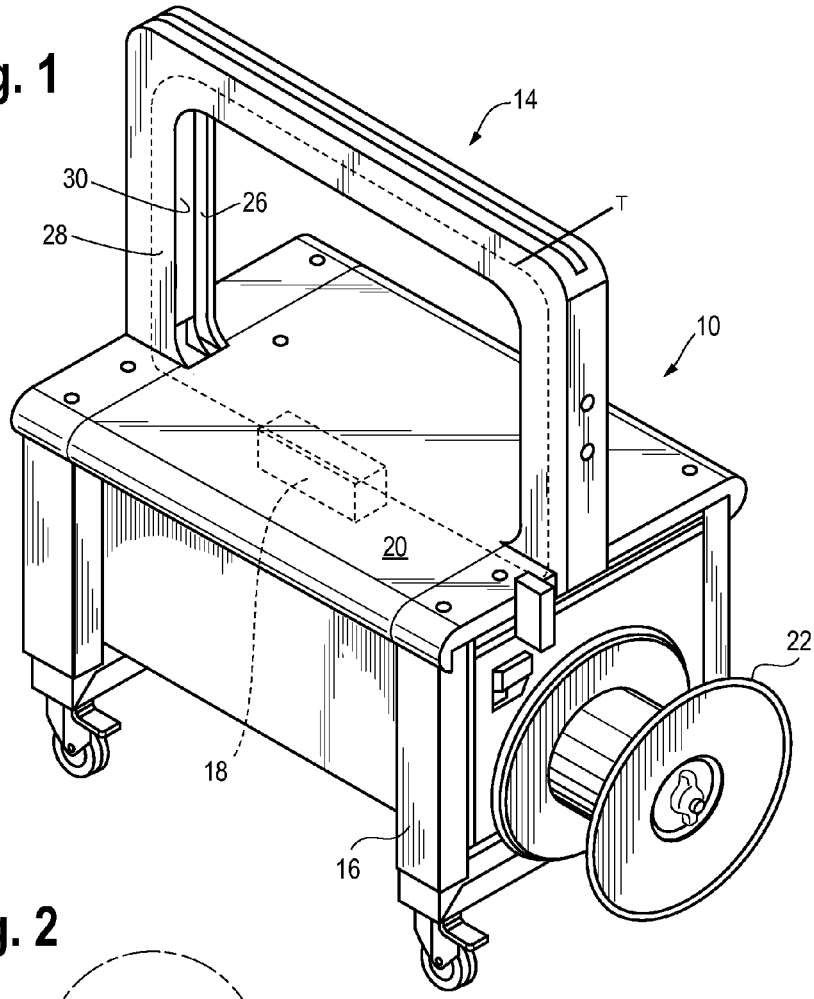
Fig. 2
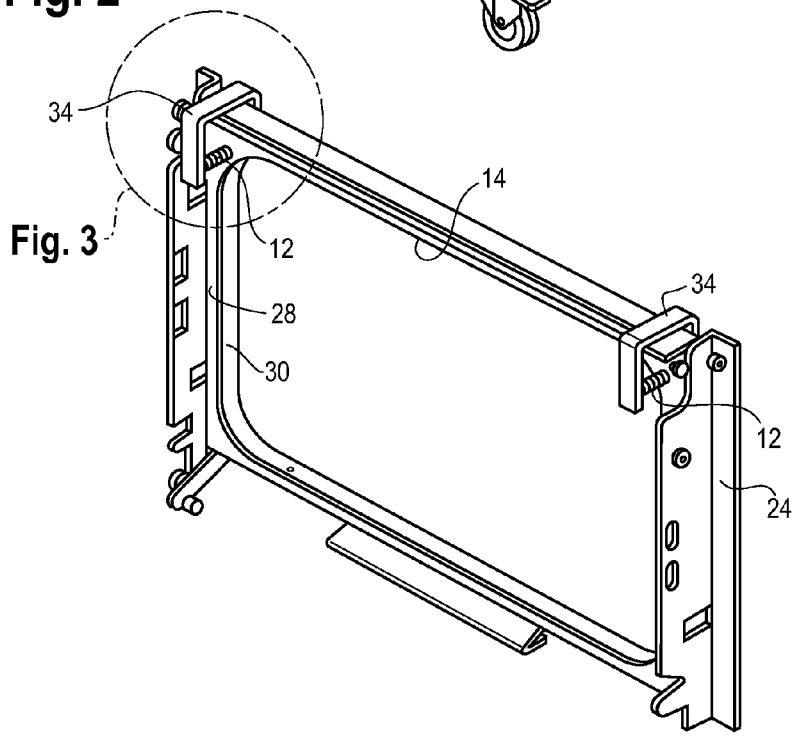
Fig. 3

SELF-ADJUSTING STRIPPER PIN FOR STRAPPING MACHINE STRAP CHUTE

CROSS-REFERENCE TO RELATED APPLICATION

This application claims the benefit of priority of Provisional U.S. Patent Application Ser. No. 61/139,185, filed Dec. 19, 2008, entitled "SELF-ADJUSTING STRIPPER PIN FOR STRAPPING MACHINE STRAP CHUTE".

BACKGROUND OF THE INVENTION

The present invention is directed to a strapping machine. More particularly, the present invention pertains to a self-adjusting stripper pin for a strapping machine strap chute to eject strap from the strap chute track.

Strapping machines are in widespread use for securing straps around loads. One type of known strapper includes a strapping head and drive mechanism mounted within a frame. A chute is mounted to the frame.

During the strapping operation, strapping material is fed from the strapping head, through the strap chute and back around to the strapping head. The strap is withdrawn from the strap chute (or chute track) and tensioned. The strap, at overlying courses, is sealed onto itself to form a strap joint. Such strapping machines and their construction and operation are disclosed in Bobren, et al., U.S. Pat. No. 7,395,754, Holden, et al., U.S. Pat. No. 7,263,928, Bobren, et al., U.S. Pat. No. 6,962,109, Lininger et al., U.S. Pat. No. 6,951,170 and Bobren, U.S. Pat. No. 6,910,318.

The strap chute is formed by inner and outer races or track walls with a gap between the races. The gap defines the chute track. The strap traverses from the strapping head, through track (the gap between the races) and back to the head.

When the strap returns to the strapping head, it is stripped from the track, tensioned, and sealed. In order to strip the strap, a stripping pin is inserted into the track, transverse to the direction of strap travel, to strip or push the strap out of the track.

Known stripper pins are one-piece pins that are fixed in place. The back side of the pin is held against a rigid surface and the opposing side of the pin is held in place by a compression spring. In the closed chute position, the tip of the pin remains partially in the track but out of the path of the strap. When the chute is opened (in a position such that the strap is pushed or urged out of the track), the chutes slides (with the pin fixed) and the tip of the pin pushes the strap out of the track.

When the chute is open, the pin must be about flush to about one (1) millimeter beyond the track wall edge. If the pin extends too far when the chute is open, the strap can get caught on (snagged on) the pin, which can cause a "pre-seal", which is a seal with the strap still in the chute. If the pin fails to fully eject the strap from the track, this can also result in a pre-seal.

In order to overcome the over and under pin travel problems, field changes or corrections are made in which the bracket to which the pin is secured (at the fixed back end) is bent toward or away from the chute to provide optimum pin setting. Although this fix works, it is not the most efficient manner in which to provide proper pin setting. Moreover, if maintenance is performed on the strapping machine (for example, at the chute), the field adjustment (bending of the chute) may have to be performed again to properly re-set the pin setting.

Accordingly, there is a need for a self-adjusting stripper pin to improve strap ejection from a strapping machine. Desirably such a pin can be used in place of existing fixed stripper pins. More desirably, such a stripper pin is self-aligning and self limiting relative to the chute track. More desirably still, such a stripper pin is biased to provide tolerance in movement.

BRIEF SUMMARY OF THE INVENTION

A strapping machine with improved strap ejection includes a self-adjusting stripper pin for use in with a strap chute of the strapping machine. The strapping machine is configured to feed a strapping material around a load, and position, tension, and seal the strapping material around the load. The strapping machine has a frame, a strap chute mounted to the frame including at least one fixed wall cooperating with at least one movable wall to define a strap path through the strap chute through which strap is conveyed and from which strap is pulled onto the load. The strap chute movable wall includes inner and outer races that define a track therebetween that define the movable wall. The movable wall is movable toward and away from the fixed wall. The movable wall has an opening therein.

The self-adjusting stripper pin includes a mount mounted to a fixed portion of the strapping machine, a reciprocating pin disposed in the mount for reciprocating movement relative to the mount, and a pin spring disposed between the pin and the mount for biasedly mounting the pin to the mount. The stripper pin mount can be mounted to a bracket fixed to the frame of the strapping machine. When the movable wall is moved toward the fixed wall, the pin moves out from the track to allow the strap to traverse therethrough. When the movable wall is moved away from the fixed wall, the pin moves into the track to urge the strap out of the track.

The pin spring positions the pin at about an outer edge of the track when the movable wall is moved away from the fixed wall. The pin includes a stop at an end thereof to prevent over-withdrawal of the pin from the track. The pin also includes a shoulder for engagement with the movable wall to prevent over-insertion of the pin into the track.

A movable wall spring biases the movable wall in the closed position. The pin is inserted in the opening in the movable wall and through an aligning inlet. A grommet is positioned on the movable wall around the opening and the aligning inlet of the movable wall and provides a seat for the mount and movable wall spring when the movable wall is moved to the open position.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein:

FIG. 1 is a perspective view of an exemplary strapping machine having a strap chute self-adjusting stripper pin embodying the principles of the present invention;

FIG. 2 is a perspective view inside of the strapping machine chute shroud, showing the strap chute track;

DETAILED DESCRIPTION OF THE INVENTION

Figure 3:
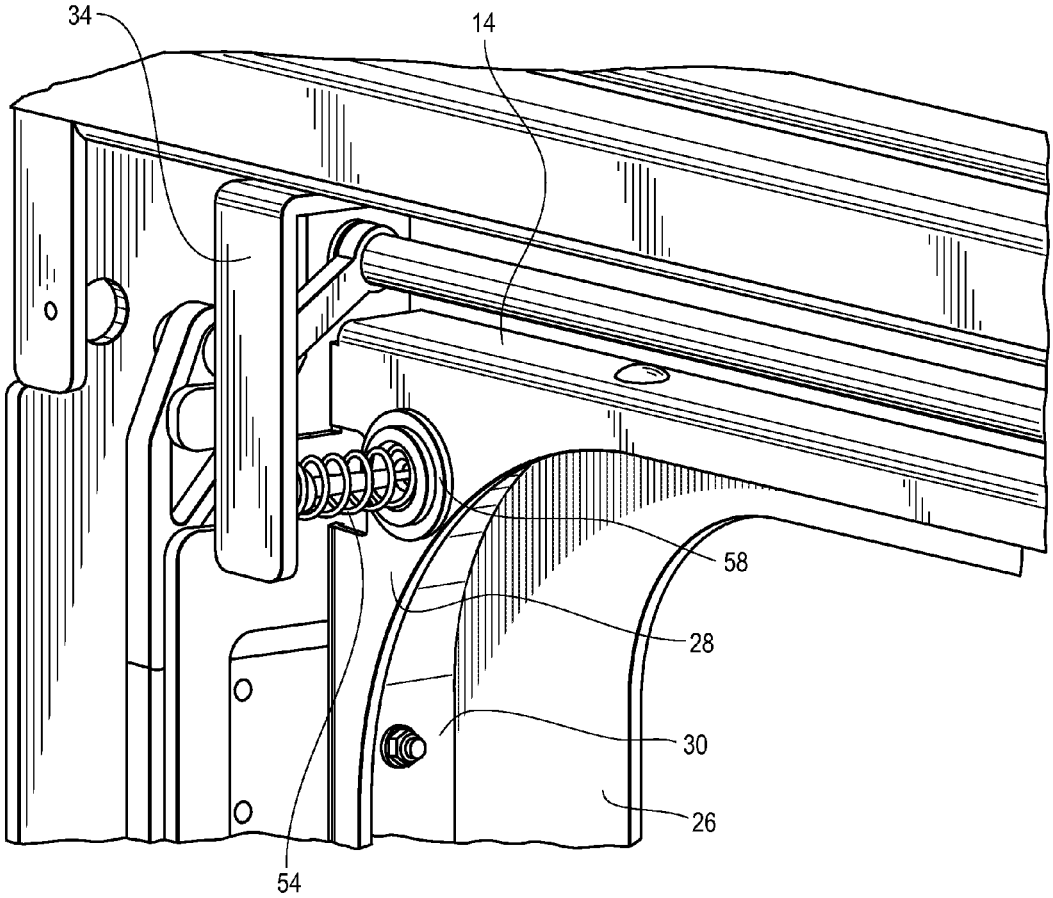
FIG. 3 is a perspective view of the strap chute and self-adjusting pin.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment(s) illustrated.

It should be further understood that the title of this section of this specification, namely, "Detailed Description Of The Invention", relates to a requirement of the United States Patent Office, and does not imply, nor should be inferred to limit the subject matter disclosed herein.

Referring to the figures and in particular FIG. 1, there is shown generally a strapping machine 10 with self-adjusting stripper pins 12 embodying the principles of the present invention. The strapping machine 10 is of the type configured to feed a strapping material S around a load, and position, tension, and seal the strapping material around the load. The strapping machine 10 includes a strap chute 14 for carrying the strap S around the load and for releasing the strap material from the strap chute 14.

The strapping machine 10 includes, generally, a frame 16 and the strap chute 14. A strapping head 18 is positioned below a work or support surface 20. A dispenser 22 dispenses strap S to the strapping head 18 as required.

Figure 4A:
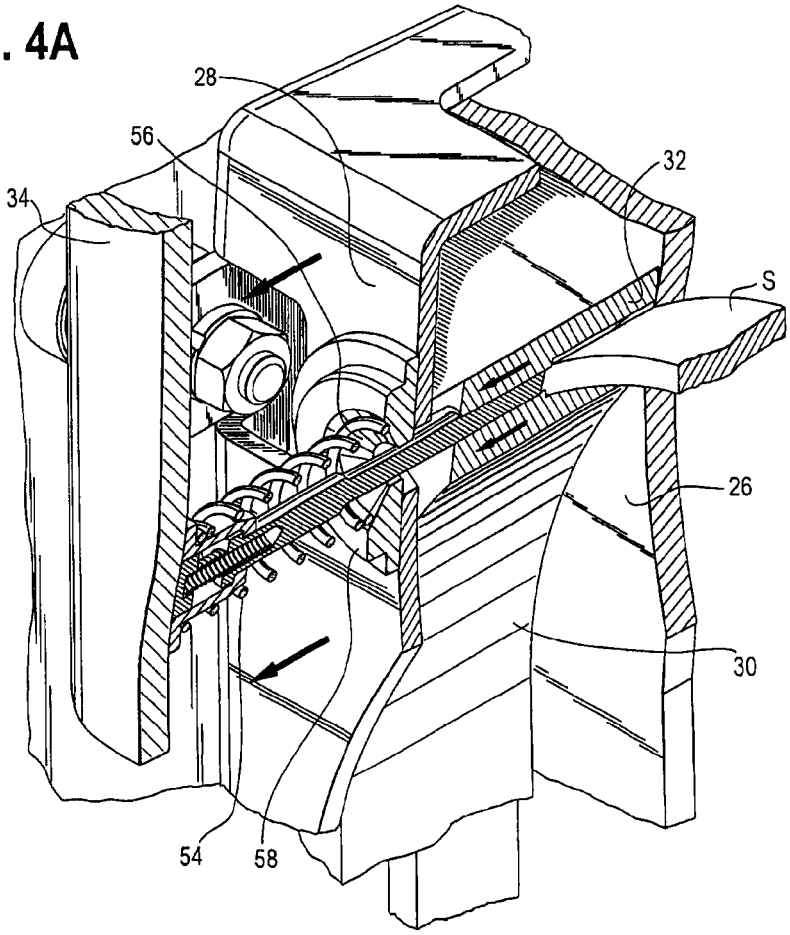
FIGS. 4A and 4B are perspective (4A) and cross-section (4B) views of the strap chute and self-adjusting stripper pin with the chute in the closed position.
Figure 4B:
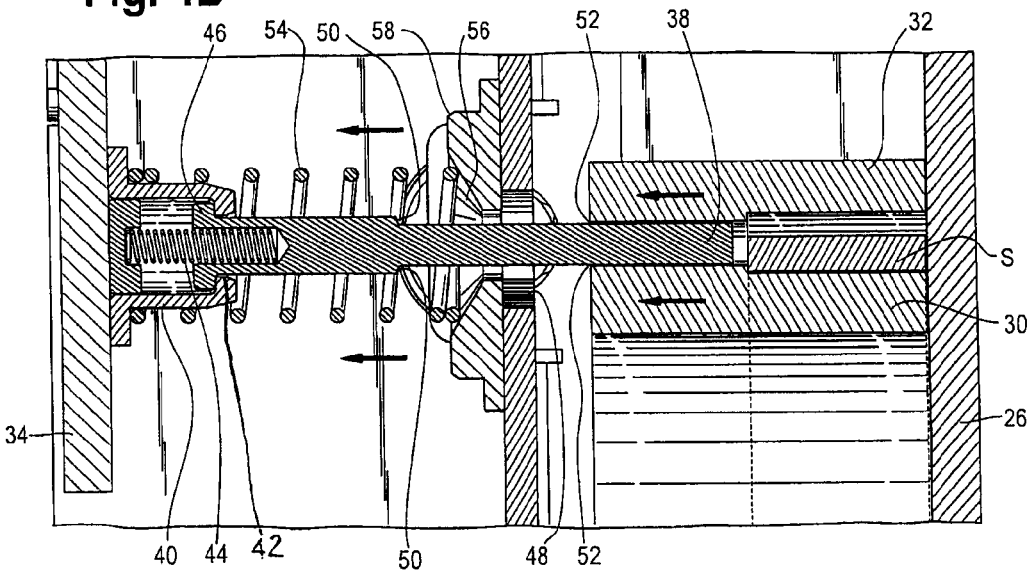
Figure 5A:
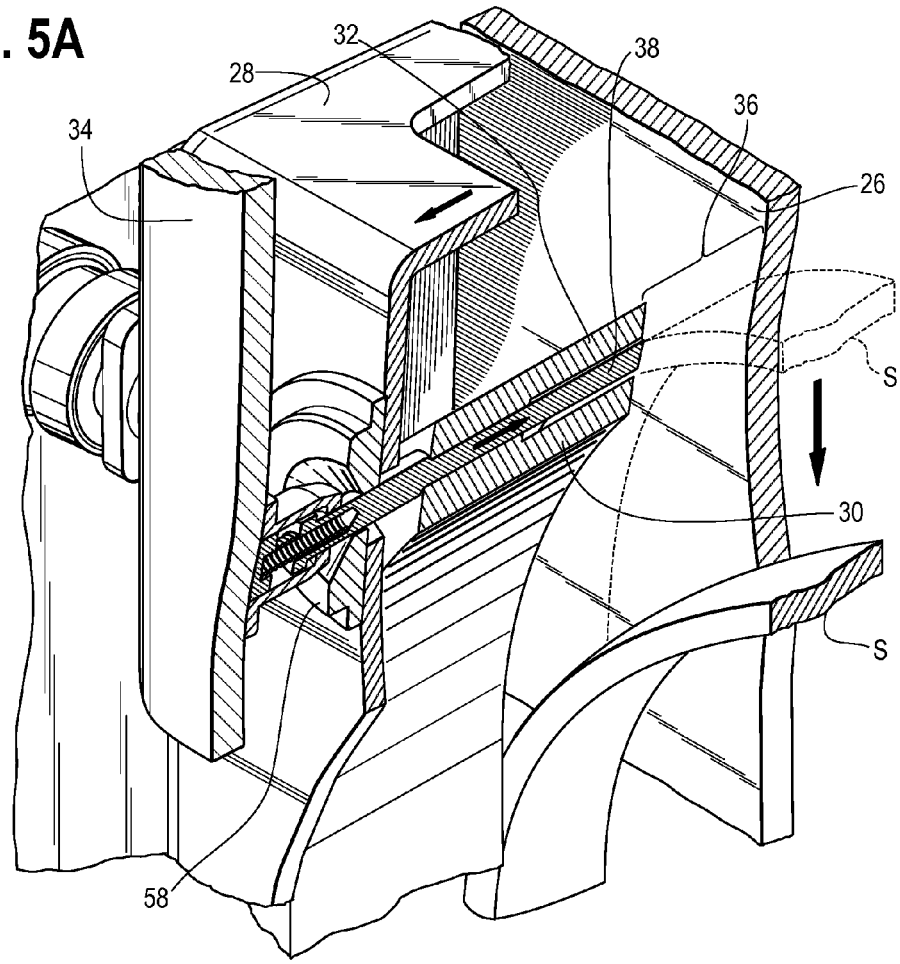
FIGS. 5A and 5B are perspective (5A) and cross-section (5B) views of the strap chute and self-adjusting stripper pin in the chute open position.
Figure 5B:
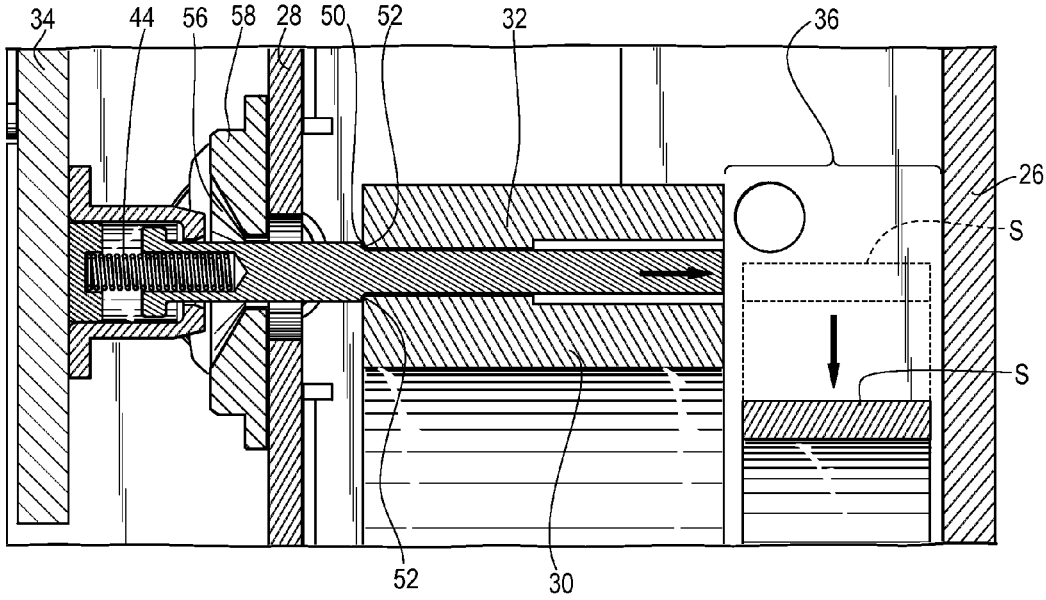

The strap chute 14 is formed having a chute frame 24 with a fixed wall 26 and a movable wall 28 defining a track T for conveying the strap S through the strap chute 14. The moveable wall 28 is movable relative to the fixed wall 26. The moveable wall 28 includes inner and outer races 30, 32 or walls and is parallel to the longitudinal axis of the strap S between an operating position (FIGS. 4A and 4B) and a release position (FIGS. 5A and 5B) of the strap chute 14. The fixed wall 26 is transverse to the longitudinal axis of the strap S between an operating position (FIGS. 4A and 4B) and a release position (FIGS. 5A and 5B) of the strap chute 14. The moveable wall 28 is biasedly mounted to the chute frame 16 or to a clip or bracket 34 on the frame 16.

During operation, with the strap chute 14 closed (FIGS. 4A and 4B), strap S is conveyed through the chute 14. When, during the cycle, strap S is to be pulled from the chute 14 onto the load, the movable wall 28 moves away from the fixed wall 26 to create a space 36 (see FIG. 5B) between the fixed and movable walls, 26, 28.

To assure that the strap S is moved (urged) out of the movable wall 28 (out from between the inner and outer races, 30, 32—see FIGS. 4-5), the present self-adjusting stripper pin 12 is mounted to a fixed surface of the strapping machine 10. In one embodiment, the stripper pin 12 is mounted to the clip or bracket 34 that supports the movable wall 28.

The stripper pin 12 includes a reciprocating pin 38 and a mount 40 on the bracket 34. A back end 42 of the pin 12 resides in the mount 40. The pin 12 is reciprocal in the mount 40, and a spring 44, between the pin back. end 42 and the mount 40 urges the pin 12 to an extended position. A stop 46 on the back end 42 of the pin 12 retains the pin 12 in the mount 40.

The pin 12 enters through an opening 48 in the movable wall 28 of the strap chute 14 and inserts between the inner and outer races 30, 32. When the movable wall 28 is moved to the open position, the pin 12 pushes the strap S from between the races 30, 32 into the space 36 between the fixed and movable walls, 26, 28.

The pin 12 has a shoulder 50 that is configured to engage edges 52 of the inner and outer races 30, 32 when the pin 12 is fully inserted between the races 30, 32. The spring 44 is positioned to urge contact of the pin shoulder 50 and the race wall or edges 52 to properly position the pin 12 in the movable wall 28 (that is, so that the pin 12 fully urges the strap S out of the movable wall 28, but the pin 12 does not extend out so far as to have the strap S hang up on the pin 12).

As seen in FIG. 3, another spring 54 (the movable wall 28 spring) is positioned about or around the pin 12, between the fixed bracket 34 and the movable wall 28 to bias the movable wall 28 into the closed position. The opening 48 in the movable wall 28 can include a tapered or aligning inlet 56 to maintain the pin 12 aligned or centered as it moves into and out of the movable wall 28. A grommet or washer 58 can be positioned on the movable wall 28, around the opening 48 to provide a seat for the mount 40 when the movable wall 28 is moved to the open position and to provide a seat for the movable wall spring 54.

It will be appreciated that the pin spring 44 provides proper inward positioning of the pin 12 (fully inserted), when the movable wall 28 is in the open position and the shoulder 50 engaging the race edge or wall 52 prevents over insertion. Conversely, when the chute 14 is in the closed position, the stop 46 on the back end 42 of the pin 12 assures that as the chute 14 is moved to the closed position, the pin 12 is fully withdrawn from the movable wall 28 so as to not interfere with the strap S moving through the chute 14.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A self-adjusting stripper pin in combination with a strap chute for a strapping machine, a strapping machine configured to feed a strapping material around a load, and position, tension, and seal the strapping material around the load, the strapping machine having a frame, a strap chute mounted to the frame including at least one fixed wall cooperating with at least one movable wall to define a strap path through the strap chute through which strap is conveyed and from which strap is pulled onto the load, the strap chute movable wall including inner and outer races that define a track therebetween that define the movable wall, the movable wall movable toward and away from the fixed wall, the movable wall having an opening therein, the self-adjusting stripper pin comprising:

a mount mounted to a fixed portion of the strapping machine, a reciprocating pin disposed, at least in part, in the mount for reciprocating movement relative to the mount; and a pin spring positioned within the mount, the pin spring disposed between the pin and the mount for biasedly mounting the pin to the mount, wherein, when the movable wall is moved toward the fixed wall, the pin moves out from the track to allow the strap to traverse therethrough, and when the movable wall is moved away from the fixed wall, the pin is moved into the track to urge the strap out of the track, and wherein the spring positions an end of the pin at about an outer edge of the track when the movable wall is moved away from the fixed wall.

2. The self-adjusting stripper pin in accordance with claim 1 wherein the pin includes a stop at an end thereof to prevent over-withdrawal of the pin from the track.

3. The self-adjusting stripper pin in accordance with claim 1 wherein the pin includes a shoulder thereon for engagement with the movable wall to prevent over-insertion of the pin into the track.

4. The self-adjusting stripper pin in accordance with claim 1 including a movable wall spring for biasing the movable wall in the closed position.

5. The self-adjusting stripper pin in accordance with claim 1 wherein the pin is inserted in the opening in the movable wall and through an aligning inlet.

6. The self-adjusting stripper pin in accordance with claim 5 wherein a grommet is positioned on the movable wall around the opening in the movable wall.

7. The self-adjusting stripper pin in accordance with claim 6 wherein the grommet defines a seat for the mount when the movable wall is moved to the open position.

8. The self-adjusting stripper pin in accordance with claim 1 including a bracket for mounting the stripper pin mount.

9. The self-adjusting stripper pin in accordance with claim 8 wherein the bracket is fixed to the frame of the strapping machine.

10. A strapping machine with improved strap ejection comprising:

a strapping machine configured to feed a strapping material around a load, and position, tension, and seal the strapping material around the load, the strapping machine having a frame, a strap chute mounted to the frame including at least one fixed wall cooperating with at least one movable wall to define a strap path through the strap chute through which strap is conveyed and from which strap is pulled onto the load, the strap chute movable wall including inner and outer races that define a track therebetween that define the movable wall, the movable wall movable toward and away from the fixed wall, the movable wall having an opening therein; and a stripper pin for the strapping machine wherein the stripper pin includes: a mount mounted to a fixed portion of the strapping machine and a reciprocating pin disposed, at least in part, in the mount for reciprocating movement relative to the mount, and a pin spring positioned within the mount, the pin spring disposed between the pin and the mount for biasedly mounting the pin to the mount, such that when the movable wall is moved toward the fixed wall, the pin moves out from the track to allow the strap to traverse therethrough, and when the movable wall is moved away from the fixed wall, the pin is moved into the track to urge the strap out of the track, and wherein the spring positions the pin at about an outer edge of the track when the movable wall is moved away from the fixed wall.

11. The strapping machine in accordance with claim 10 wherein the pin includes a stop at an end thereof to prevent over-withdrawal of the pin from the track.

12. The strapping machine in accordance with claim 10 wherein the pin includes a shoulder thereon for engagement with the movable wall to prevent over-insertion of the pin into the track.

13. The strapping machine in accordance with claim 10 including providing a movable wall spring for biasing the movable wall in the closed position.

14. The strapping machine in accordance with claim 10 wherein the pin is inserted in the opening in the movable wall and through an aligning inlet.

15. The strapping machine in accordance with claim 14 wherein a grommet is positioned on the movable wall around the opening in the movable wall.

16. The strapping machine in accordance with claim 15 wherein the grommet provides a seat for the mount when the movable wall is moved to the open position.

17. The strapping machine in accordance with claim 10 including providing a bracket for mounting the stripper pin.

18. The strapping machine in accordance with claim 17 wherein the bracket is fixed to the frame of the strapping machine.

* * * * *